United States Patent [19]

Warden

[11] Patent Number: 4,951,095

[45] Date of Patent: Aug. 21, 1990

[54] COPYING APPARATUS WITH IMAGE SMEAR CONTROL

[75] Inventor: Geoffrey L. Warden, Cookham, England

[73] Assignee: Xerox Corporation, Stamford, Conn.

[21] Appl. No.: 297,629

[22] Filed: Jan. 13, 1989

[30] Foreign Application Priority Data

Jan. 15, 1988 [GB] United Kingdom ..... 8800867
Jan. 15, 1988 [GB] United Kingdom ..... 8800868

[51] Int. Cl.[5] ..... G03G 15/16
[52] U.S. Cl. ..... 355/273; 355/309
[58] Field of Search ..... 355/271, 273, 274, 309, 355/317

[56] References Cited

U.S. PATENT DOCUMENTS

| | | | |
|---|---|---|---|
| 4,017,067 | 4/1977 | Soures et al. | 271/80 |
| 4,025,187 | 5/1977 | Taylor et al. | 355/14 |
| 4,092,021 | 5/1978 | Fletcher | 271/176 |
| 4,355,881 | 10/1982 | Tarumi et al. | 355/3 FU |
| 4,372,669 | 2/1983 | Fantuzzo et al. | 355/3 R |
| 4,519,700 | 5/1985 | Barker et al. | 355/317 X |
| 4,541,711 | 9/1985 | Takahashi | 355/317 X |
| 4,561,756 | 12/1985 | Lang | 355/35 H |

OTHER PUBLICATIONS

*Xerox Disclosure Journal,* vol. 1, No. 5, May 1976, "Copy Sheet Registration System", Looney, J., pp. 85–86.

*Primary Examiner*—Joan H. Pendegrass
*Attorney, Agent, or Firm*—William A. Henry

[57] ABSTRACT

A xerographic copying machine has a circulating endless belt photoreceptor. A toner image is transferred from the photoreceptor to a copy sheet at the transfer region. The sheet is fed to the transfer region by a pair of coating rolls driven by a variable speed stepper motor. The rolls feed the leading portion of the copy sheet at approximately the same speed as the photoreceptor. When the copy sheet contacts the photoreceptor the feed rolls are driven at a faster speed for a short interval to generate a buckle in the copy sheet just before the transfer region. The speed of the feed rolls is then returned to its initial value so that the buckle size remains constant while the remainder of the sheet is fed. The buckle provides sufficient surplus in the copy sheet to prevent it being pulled taut in the transfer region. This prevents smearing the unfused toner image. Also, the buckle bears against the concave guide surface of guide member which acts to stiffen the copy sheet in the process direction at the transfer station. This helps to reduce the tendency for any post-transfer lead-edge "socks" from propagating back to the transfer station which can also cause image smear.

8 Claims, 1 Drawing Sheet

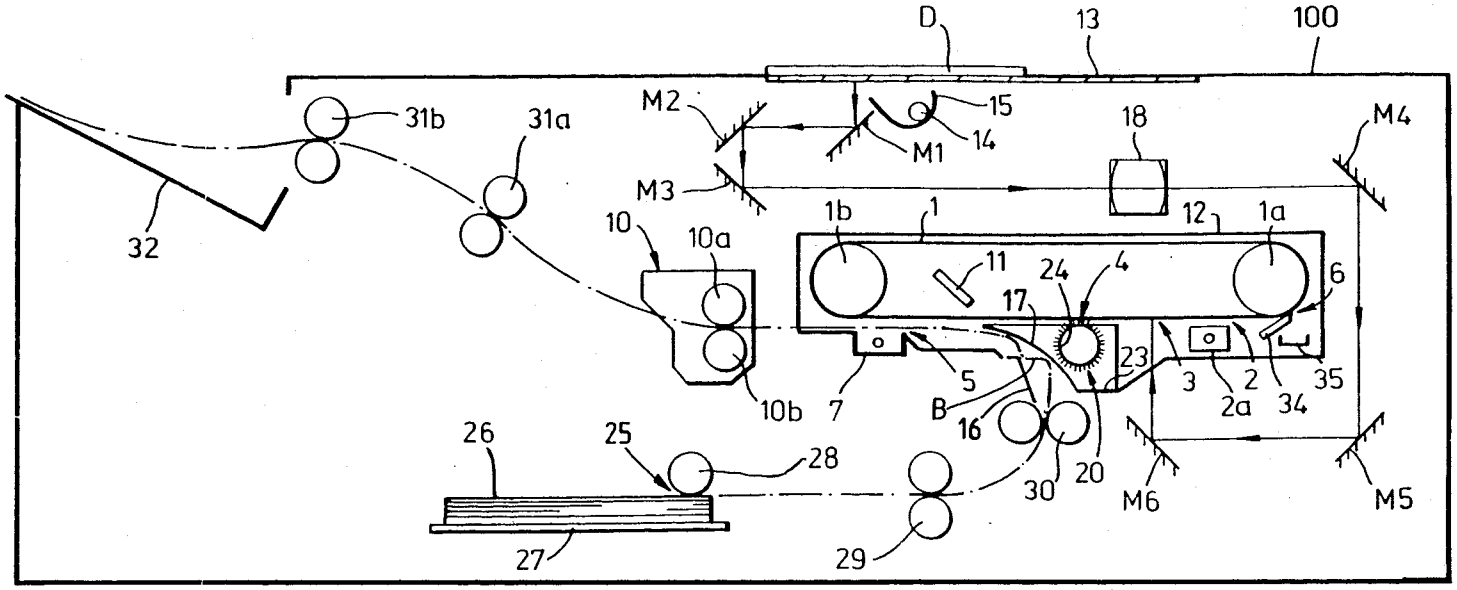
100
13
D
15
14
M1
M2
M3
M4
M5
M6
18
12
1a
1
1b
6
35
34
2
2a
3
23
4
24
11
17
5
B
16
20
30
7
10
10a
10b
28
29
25
27
26
31a
31b
32

COPYING APPARATUS WITH IMAGE SMEAR CONTROL

This invention relates to an electrostatographic copying machine comprising a circulating imaging member, a transfer region where a developed toner image may be transferred from the imaging member to a copy sheet, and means for feeding the copy sheet to the transfer region.

In electrostatographic copiers generally there is a requirement to maintain close control between the speed of the photoreceptor and the speed at which the copy sheet is fed to the photoreceptor at the transfer region otherwise the unfused toner image may be smeared during transfer to the copy sheet. Unfortunately, tolerances in the sheet feed means may give rise to speed mismatch resulting in smearing "of images on the copy sheet".

Also, a problem with known electrostatographic copiers is that the lead edge of the copy sheet may be slowed down when it comes into contact with, for example, post-transfer paper guides or the fuser itself, and this "shock" can propagate through the copy sheet back to the transfer station resulting in smearing of the unfused toner image as it is transferred to the copy sheet. Although attempts have been made to design the paper path to minimise this effect, the problem has not been eliminated especially because copy sheets tend to deviate unpredictably from the desired trajectory due to variations in paper properties. For example, a transfer-fuser speed compensating apparatus is disclosed in U.S. Pat. No. 4,017,067 that includes a vacuum controlled guide surface that is positioned between an image support surface and a fuser. In U.S. Pat. No. 4,092,021 a conductive baffle that is electrically connected and closely spaced from a guide member is used to provide a low electrostatic zone between the baffle and the guide member to thereby allow movement of a copy sheet with an unfused image thereon therebetween without electrical disturbance of the image. A printing machine is disclosed in U.S. Pat. No. 4,372,669 that has a baffle between the transfer area and fuser area for transport of sheets therebetween. It appears that unimaged sides of sheets leaving the transfer area are electrostatically attached to the baffle for transport to the nip in the fuser. A recording apparatus is disclosed in U.S. Pat. No. 4,355,881 that includes a roller type fixing device made up of a first roller and a second roller for fixing the image to the transfer paper. The recording apparatus has an upper guide plate placed over the transfer paper passage on the inlet side of the roller type fixing device, the upper guide plate being curved down gradually toward the front end and extending near the lower portion of the first roller. The upper guide plate has on its underside a plurality of projection stripes extending in the direction of paper feed.

Other relevant prior art includes U.S. Pat. No. 4,561,756 which discloses running registration rolls constantly at a faster speed than the photoreceptor to create a buckle in a sheet to prevent image smear. However, a problem with this approach is that the buckle is dependent on paper size. The speed mismatch can a large buckle to develop which can cause the paper to crumple in the confined pre-transfer region. U.S. Pat. No. 4,025,187 to Taylor et al. discloses a sheet feeding apparatus for a reproducing machine that forms a buckle in a sheet utilising a buckle controlled system and a sensor for the leading edge of the sheet. The buckle is formed upstream of sheet registration rolls simply by stopping the registration rolls for a predetermined - but adjustable - time interval.

According to the present invention there is provided an electrostatographic copying machine comprising a circulating imaging member, a transfer region where a developed toner image may be transferred from the imaging member to a copy sheet, and sheet feed means for feeding the copy sheet to the transfer region wherein the sheet feed means are adapted (a) to feed a first leading portion of the sheet at a first speed substantially the same as the speed of the photoreceptor, (b) to feed a second subsequent portion of the sheet at a second speed greater than the first speed, and (c) to feed the remaining portion of the sheet at the first speed.

Thus, in accordance with the present invention, the speed of the sheet feed means is variable. Initially, each sheet is fed to the transfer region at a speed as close as possible to that of the photoreceptor. Preferably when the lead edge of the copy sheet is tacked to the photoreceptor surface the speed of the sheet feed means is increased for a short interval thereby creating a small buckle in the paper. The speed of the sheet feed means is then returned to its initial value so that the size of the buckle remains approximately constant while the remainder of the sheet is fed. The buckle provides sufficient slack in the sheet to prevent it being pulled taut in the transfer region which would lead to image smear. Also, the buckle generated need only be relatively small, and since it is maintained substantially constant in size, there is no need to provide a large space to accommodate the buckle without damaging the copy sheet. This is particularly advantageous for a compact copying machine.

In a preferred embodiment the copier also includes between the feeding means and the transfer region a copy sheet guide having a concave guide surface adjacent the area where the buckle is induced in the copy sheet. Hence the buckle is forced into intimate contact with the concave surface of the guide to enhance the stiffening of the copy sheet at the transfer station and so reduce the tendency for any post-transfer lead edge "shocks" to propagate back through the transfer region.

An embodiment of the invention will now be described, by way of example, with reference to the accompanying drawing in which:

The single Figure is a schematic cross section of a xerographic copying machine in accordance with the invention.

The xerographic copier in the Figure includes an endless flexible photoreceptor belt 1 mounted for rotation (in the clockwise direction as shown in the Figure) about support rollers 1*a* and 1*b* to carry the photosensitive imaging surface of the belt 1 sequentially through a series of xerographic processing stations, namely a charging station 2, an imaging station 3, a development station 4, a transfer station 5, and a cleaning station 6.

The charging station 2 comprises a corotron 2*a* which deposits a uniform electrostatic charge on the photoreceptor belt 1.

An original document D to be reproduced is positioned on a platen 13 and is illuminated in known manner a narrow strip at a time by a light source comprising a tungsten halogen lamp 14. Light from the lamp is concentrated by an elliptical reflector 15 to cast a narrow strip of light on to the side of the original document D facing the platen 13. Document D thus exposed is imaged onto the photoreceptor 1 via a system of mirrors M1 to M6 and a focussing lens 18. The optical image selectively discharges the photoreceptor in image configuration whereby an electrostatic latent image of the original document is laid down on the belt surface at imaging station 3. In order to copy the whole original document the lamp 14, the reflector 15, and the mirror M1 are mounted on a full rate carriage (not shown) which travels laterally at a given speed below the platen and thereby scans the whole document. Because of the folded optical path the mirrors M2 and M3 are mounted on another carriage (not shown) which travels laterally at half the speed of the full rate carriage in order to maintain the optical path constant. The photoreceptor 1 is also in motion whereby the image is laid down strip by strip to reproduce the whole of the original document as an image on the photoreceptor.

At the development station 4, a magnetic brush developer system 20 develops the electrostatic latent image into visible form. Here, toner is dispensed from a hopper (not shown) in to developer housings 23 which contains a two-component developer mixture comprising a magnetically attractable carrier and the toner, which is deposited on the charged area of belt 1 by a developer roll 24.

The developed image is transferred at the transfer station 5 from the belt to a sheet of copy paper which is delivered inot contact with the belt in synchronous relation to the image from a paper supply system 25 in which a stack of paper copy sheets 26 is stored on a tray 27. The top sheet of the stack in the tray is brought, as required, into feeding engagement with the top sheet separator/feeder 28. Sheet feeder 28 feeds the top copy sheet of the stack towards the photoreceptor around a 180° path via two sets of nip roll pairs 29 and 30. The path followed by the copy sheets is denoted by a broken line in the Figure. At the transfer station 5 a transfer corotron 7 provides an electric field to assist in the transfer of the toner particles to the copy sheet.

The feed roll pair 30 is driven by a variable speed motor (not shown) such as a conventional stepper motor. When the leading edge of a copy sheet enters the nip of the feed rolls 30, the feed rolls 30 are driven at a speed approximately equal to that of the photoreceptor. A first portion of the copy sheet is fed constantly at this same speed and initially the copy sheet is guided to the entrance of the transfer station 5 by an inverted 'L'-shaped guide member 16 on the lower side of the copy sheet. When the leading edge of the sheets enters the transfer station 5 and is tacked to the photoreceptor belt 1 the speed of the feed rolls 30 is increased for a short period to generate a slight excess of paper, for example 5 mm, in the paper path between the feed roll 30 and the transfer station 5, which induces a small buckle B in the vicinity of the paper guide 17 immediately before the entrance to the transfer station 5. This slight paper surplus immediately before the transfer station prevents the paper pulling taut and so avoids smearing of the unfused toner image. As the size of the buckle B grows it is forced into intimate contact with the concave surface of the upper guide member 17. This causes the copy sheet to stiffen in the process direction and so reduce the tendency for any "shocks", which may be generated when the lead edge of the copy sheet contacts post-transfer paper guides and/or enters the fusing station, from propagating back to the transfer station and so reduces the occurrence of toner image smear, as discussed above. After the short interval at the higher speed, the feed rolls are then returned to their original speed for feeding the final portion of the copy sheet during which time the buckle size remains constant.

It will be evident that the relative lengths of paper fed at the two different speeds and the size of the buckle will depend on the particular architecture of the copier in the region of the transfer station and the paper path thereto. By way of example, however, in a configuration used by the applicants the first 80 mm of the copy sheet is fed initially at a speed of 17.2 $cms^{-1}$. The speed is then increased to 20.5 $cms^{-1}$ to feed the next 32 mm portion of the sheet which generates a paper excess of approximately 5 mm, hence inducing the buckle B. The speed is then returned to the initial value for the remainder of the sheet. The same conditions may be applied, independent of paper size. The stepper motor parameters may be changed as follows. Starting when the lead edge of the copy sheet enters the feed roll nip the motor runs for 100 steps at 5 ms per step. With 19 mm diameter feed rolls the first 80 mm of the copy sheet is fed at a linear speed of 17.2 $cms^{-1}$. The timing of the motor is then changed to 4 ms per step for the next 35 steps which results in the subsequent 32 mm portion of the sheet being fed at a linear speed of 20.5 $cms^{-1}$. The timing of the motor is then changed back to 5 ms per step for feeding the remaining portion of the copy sheet at the initial linear speed of 17.2 $cms^{-1}$.

The copy sheet bearing the developed image is then stripped from the belt 1 and subsequently conveyed to a fusing station 10 which comprises a heated roll fuser to which release oil may be applied in known manner. The image is fixed to the copy sheet by the heat and pressure in the nip between the two rolls **10*a* and 10*b* of the fuser. The final copy is fed by the fuser rolls into catch tray 32 via two further nip roll pairs 31*a* and 31*b***.

After transfer of the developed image from the belt some toner particles usually remain on the surface of the belt, and these are removed at the cleaning station 6 by a doctor blade 34 which scrapes residual toner from the belt. The toner particles thus removed fall into a receptacle 35 below. Also, any electrostatic charges remaining on the belt are discharged by exposure to an erasure lamp 11 which provides an even distribution of light across the photoreceptor surface. The photoreceptor is then ready to be charged again by the charging corotron **2*a*** as the first step in the next copy cycle.

The photoreceptor belt 1, the charge corotron **2*a*, the developer system 20, the transfer corotron 7, and the cleaning station 6 may all be incorporated in a process unit 12 adapted to be removable mounted in the main assembly 100** of the xerographic copier.

In view of the foregoing description it will be evident to a person skilled in the art that various modifications may be made within the scope of the invention. For example, the paper path configuration at the entrance to the transfer station may differ substantially from that shown in the Figure. Also, the variable speed motor need not be a stepper motor but may instead be either an A.C. or D.C. motor with a variable speed clutch or gearbox.

We claim:

1. An electrostatographic copying machine comprising a circulating imaging member, a transfer region where a developed toner image may be transferred from the imaging member to a copy sheet, and sheet feed means for feeding the copy sheet to the transfer region wherein said sheet feed means are adapted (a) to feed a first leading portion of the sheet at a first speed substantially the same as the speed of said imaging member, (b) to feed a second subsequent portion of the sheet at a second speed greater than the first speed, and (c) to feed the remaining portion of the sheet at the first speed in order to induce a buckle in the sheet and thereby control image smear.

2. An electrostatographic copying machine as claimed in claim 1, wherein said sheet feed means are adapted to feed the second portion of the sheet at the second speed after the leading edge of the copy sheet contacts said imaging member.

3. An electrostatographic copying machine as claimed in claim 1, wherein said sheet feed means is adapted to feed said first portion of the sheet at said first speed for a first predetermined time period.

4. An electrostatographic copying machine as claimed in claim 3, wherein said sheet feed means is adapted to feed said second portion of the sheet at said second speed for a second predetermined time period.

5. An electrostatographic copying machine as claimed in claim 4, wherein said means for feeding the copy sheet to the transfer region comprises a pair of coacting rolls.

6. An electrostatographic copying machine as claimed in claim 5, wherein said coacting rolls are driven by a stepper motor.

7. An electrostatographic copying machine as claimed in claim 1, further comprising a first copy sheet guide between said feeding means and the transfer region, said first sheet guide having a concave guide surface adjacent the area where the buckle is induced in the copy sheet.

8. An electrostatographic copying machine as claimed in claim 7, comprising a second copy sheet guide adjacent the area where the buckle is induced in the copy sheet, said second copy sheet guide being disposed on the opposite side of the copy sheet from the first sheet guide.

* * * * *